US007578612B2

(12) United States Patent
Zhang et al.

(10) Patent No.: US 7,578,612 B2
(45) Date of Patent: Aug. 25, 2009

(54) THREE-PHASE TILTING AGITATOR FOR MICROARRAYS

(75) Inventors: Liang Zhang, Beijing (CN); Fei J. Xian, Beijing (CN); Renyuan Chen, Beijing (CN); Lianshan Zhao, Beijing (CN); Jianxing Ye, Beijing (CN); Xianhua Wang, Beijing (CN)

(73) Assignee: CapitalBio Corporation, Beijing (CN)

( * ) Notice: Subject to any disclaimer, the term of this patent is extended or adjusted under 35 U.S.C. 154(b) by 614 days.

(21) Appl. No.: 11/194,014

(22) Filed: Jul. 29, 2005

(65) Prior Publication Data

US 2006/0030032 A1 Feb. 9, 2006

(30) Foreign Application Priority Data

Apr. 19, 2004 (CN) ..... 2004 2 0001127 U

(51) Int. Cl.
*B01F 11/00* (2006.01)

(52) U.S. Cl. ..... 366/211; 366/209; 366/217

(58) Field of Classification Search ..... 366/208, 366/209, 215, 217, 219, 210, 211; 248/317
See application file for complete search history.

(56) References Cited

U.S. PATENT DOCUMENTS

| | | | | | |
|---|---|---|---|---|---|
| 288,853 | A * | 11/1883 | Poage | 211/57.1 |
| 705,219 | A * | 7/1902 | Dempster et al. | 366/215 |
| 1,871,374 | A * | 8/1932 | John | 366/209 |
| 2,646,281 | A * | 7/1953 | Hurst | 472/14 |
| 2,757,375 | A * | 7/1956 | Rieutord et al. | 366/211 |
| 2,839,123 | A * | 6/1958 | Summitt | 297/42 |
| 4,702,610 | A * | 10/1987 | Reynolds, Jr. | 366/213 |
| 5,921,676 | A | 7/1999 | Reynolds et al. | |
| 6,942,184 | B1 * | 9/2005 | Morris | 244/138 R |

FOREIGN PATENT DOCUMENTS

| | | |
|---|---|---|
| DE | 2 230 711 | 11/1973 |
| FR | 2 501 057 | 9/1982 |
| WO | WO-96/28243 | 9/1996 |
| WO | WO-2004/034014 | 4/2004 |
| WO | WO-2004/037400 | 5/2004 |
| WO | WO-2004/105925 | 12/2004 |

OTHER PUBLICATIONS

European Search Report for EP 05 01 6569, search completed Sep. 23, 2005, 2 pages.
European Office Action for EP 05016569.5, mailed Jul. 5, 2007, 5 pages.
Response to European Office Action from EP 05016569.5, faxed on Nov. 30, 2007, 14 pages.

* cited by examiner

*Primary Examiner*—David L Sorkin
(74) *Attorney, Agent, or Firm*—Morrison & Foerster LLP

(57) ABSTRACT

A low-cost, easy to operate, three-phase tilting agitator for microarrays, including large area microarrays, provides experimentally verified improvements in hybridization intensity and uniformity. Motion is coupled from a single motor to a sample holder via three suspension tethers. The microarrays may be immersed in a water bath during agitation to maintain a temperature for the hybridization reaction. The use of traditional cover slips for the microarrays minimizes the volume requirement for target sample solution.

16 Claims, 7 Drawing Sheets

THREE-PHASE TILTING AGITATOR FOR MICROARRAYS

RELATED APPLICATION

The present invention is related to Chinese patent (utility model) application No. 200420001127.7, filed on Apr. 19, 2004, the content of which is incorporated by reference herein in its entirety.

TECHNICAL FIELD

The present invention relates to a reaction apparatus for microarrays, that is particularly suitable to large area microarrays, such as genome-wide DNA microarrays.

BACKGROUND ART

DNA microarrays are two-dimensional arrays of reference DNA on glass membranes, microscope slides, or similar substrates. Microarrays are fabricated by spotting small volumes of solution containing reference (probe) DNA onto the substrate. In gene expression profiling assays, cDNA molecules originating from test and control samples competitively bind to the spotted probe molecules on a DNA microarray. The test and the control samples are labeled with two different fluorescent dyes to determine the intensity ratio with a fluorescence scanner. A ratio of one indicates the same expression level and a ratio different from one represents an up- or down-regulation of a respective gene. DNA microarrays can have surfaces covered by thousands of spots, and each spot can contain billions of cDNA probes corresponding to a particular known gene. The targets are poured onto the probe array, the targets hybridize with the complementary probes (if present in the array), and the array is washed to removed target that did not hybridize. This approach allows a parallel, semi-quantitative analysis of thousands of transcription levels in a single experiment. Although the discussion herein uses DNA microarrays as an example, microarrays may also be used for other types of affinity assays than DNA, for example, immunological assays, that rely on the hybridization of biological molecules.

Microarray substrates are often conventional microscope slides with dimensions of 75 by 25 mm. Up to several thousand spots of oligonucleotides or cDNA proves with known identity cover the slide in a two dimensional grid. In a standard experimental set up, a buffered solution containing potential targets is sandwiched between a DNA microarray and a cover slip to form a reaction chamber with an area of several square centimeters and a height of only twenty to a hundred microns. The microarray assembly can be sealed in a humid chamber or placed in a water bath to prevent drying and/or control reaction temperature, and allowed to hybridize for a period of several hours. In such a configuration, diffusion is the only mechanism for DNA strands, or other targets, to move within the reaction chamber. However, diffusion is a notoriously slow process for molecules the size of DNA strands which may need to travel a distance of several centimeters to reach a microarray spot with a complementary probe. In such a case, the immediate vicinity of a probe spot can be quickly depleted, especially in the case of cDNA molecules representing genes with low expression.

This diffusion limitation can lead to low signal-to-noise ratios when a microarray is read because only a fraction of the molecules present in the sample may get a chance to bind to their complimentary spots. Generally speaking, when a microarray's area reaches approximately 22 cm by 22 cm, it can be defined as a large area microarray. For large area microarrays, such as genome-wide DNA microarrays, the diffusion limitation and low signal-to-noise ratios are further exacerbated because of the longer travel distances for the target molecules.

A solution to overcome the diffusion limitation and improve the reaction kinetics for better intensity and uniformity of hybridization is to agitate the target sample solution. The low height and large area of the reaction chamber formed by the microarray and the cover slip can make effective agitation difficult, especially for large area microarrays. Current approaches for agitation of the target sample solution include, for example: (i) microfluidic circulation, (ii) ultrasonic agitation, and (iii) contact with overlayed expanding and contracting air bladders. A drawback of microfluidic circulation is the requirement of three to five times as much target sample solution. The drawbacks of the ultrasonic and air bladder methods include cost and complexity of use, as well as the need for additional consumable materials. Advalytix AG of Brunnthal, Germany markets a line of products based on ultrasonic techniques. BioMicro Systems, Inc. of Salt Lake City, Utah, markets a line of products based on air bladder techniques. Both the ultrasonic and the air bladder techniques are difficult to scale up to handle large area microarrays.

In view of the above discussion, it is very desirable to have a reaction apparatus for use with microarrays that is low cost, easy to use, and capable of effectively agitating large area microarrays.

SUMMARY OF THE INVENTION

A low-cost, easy to operate, three-phase tilting agitator for microarrays, including large area microarrays, provides experimentally verified improvements in hybridization intensity and uniformity. Motion is coupled from a single motor to a sample holder via three suspension tethers. The microarrays may be immersed in a water bath during agitation to maintain a temperature for the hybridization reaction. The use of traditional cover slips for microarrays minimizes the volume requirement for target sample solution.

DETAILED DESCRIPTION OF THE INVENTION

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this section prevails over the definition that is incorporated herein by reference.

As used herein, "a" or "an" means "at least one" or "one or more."

Similar numerical references refer to similar features within the various drawings.

Figure 1:
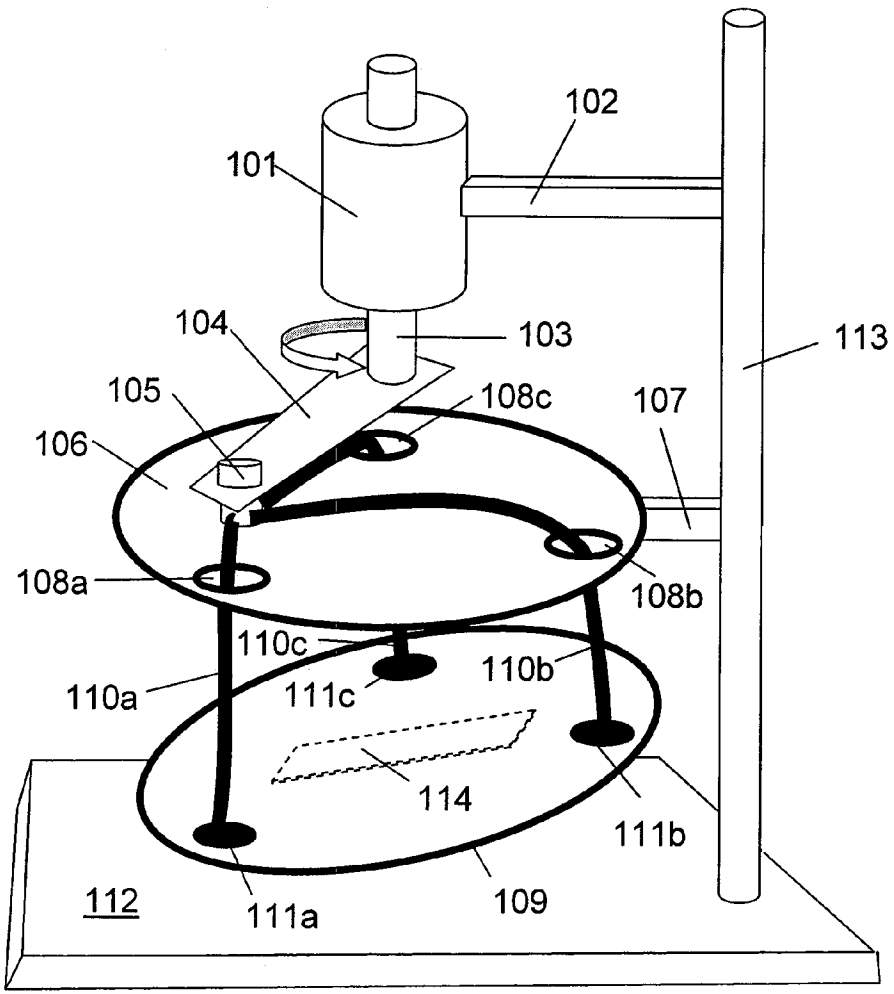
FIG. 1 illustrates a perspective view of an embodiment of the invention.

Referring to FIG. 1, a sample holder 109 (in this embodiment, a sample plate 109) is suspended by three tethers 110*a*, 110*b*, and 110*c* attached to sample plate 109 at attachment points 111*a*, 111 *b*, and 111*c*, respectively. Although sample plate 109 is illustrated as a planar disc in this embodiment, the sample holder can be other structures such as trays, compartmented trays, single or multiple microarray cassette holders, or other types of container in other embodiments. Suspension tethers 110*a*, 110*b*, and 110*c* pass through orifices 108*a*, 108*b*, and 108*c*, respectively, of the tether separation structure 106 (in this case a tether separation plate), where all three tethers are coupled to bearing 105. Normally, but not necessarily, suspension tethers 110*a*, 110*b*, and 110*c* are of substantially the same length. Normally, but not necessarily, orifices 108*a*, 108*b*, and 108*c* are at substantially equal angular separations. Bearing 105 is coupled to a radial member 104 (in this embodiment, a radial arm), that is rotationally driven by motor 101 via shaft 103. Motor 101 and tether separation plate 106 are coupled to structural support 113 via coupling members 102 and 107, respectively. Structural support 113 is mounted on base 112. In normal operation, a microarray 114 can be placed on sample plate 109.

Figure 2:
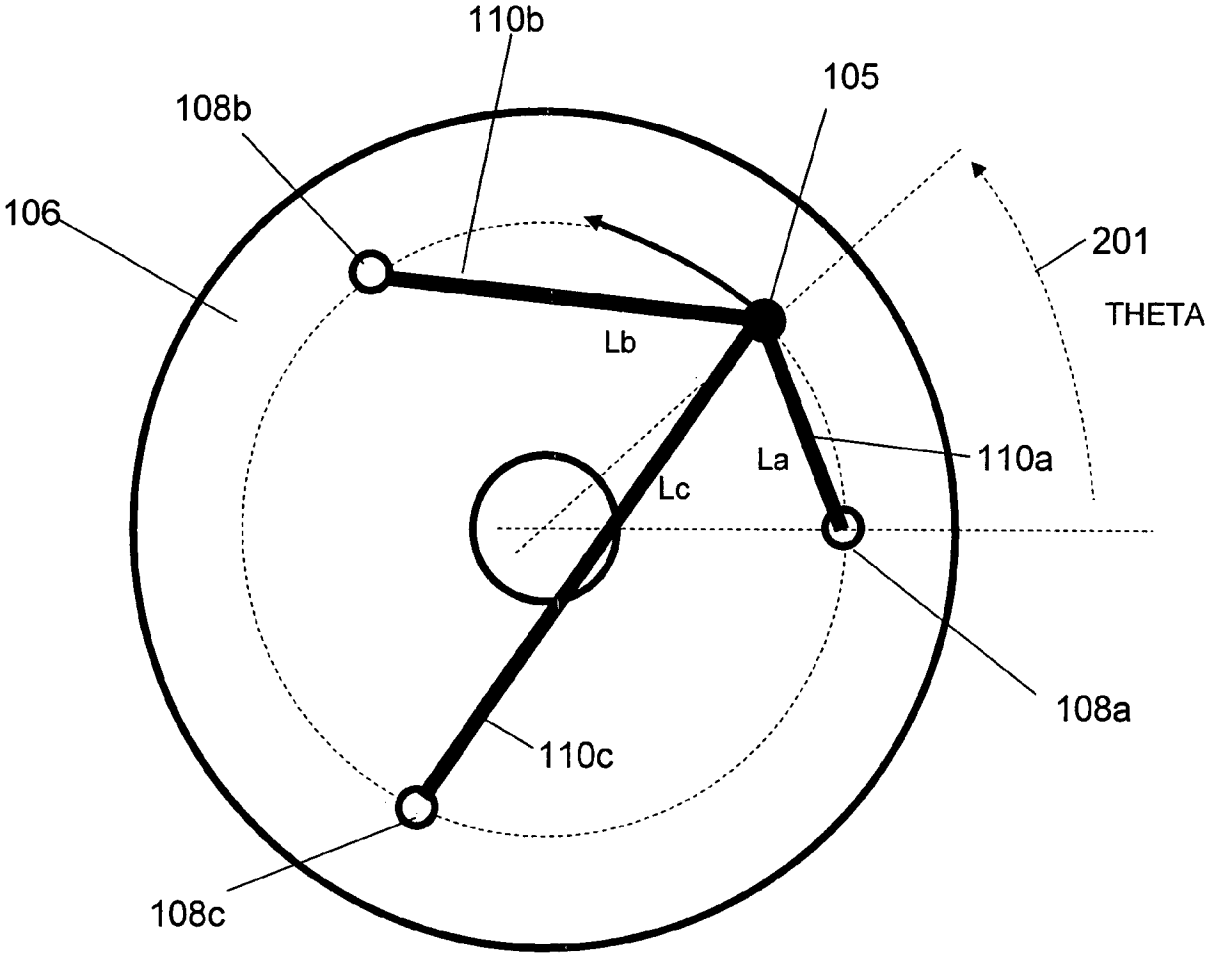
FIG. 2 illustrates a top view of a suspension tether separation plate in an embodiment of the invention.
Figure 3B:
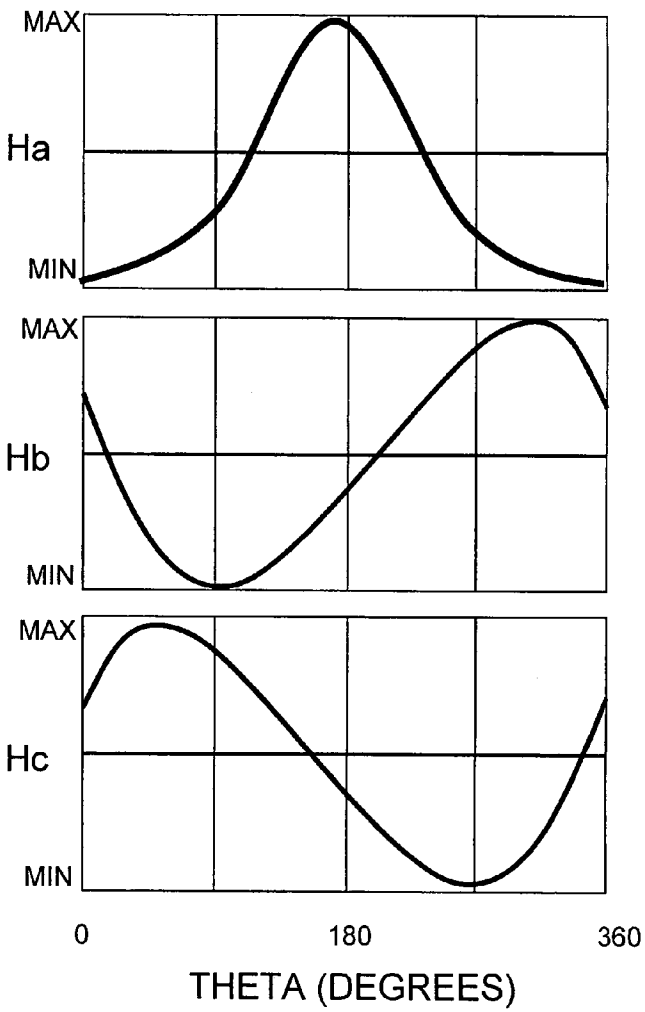
FIG. 3*b* shows plots sample plate attachment point heights according to an embodiment of the invention.
Figure 3A:
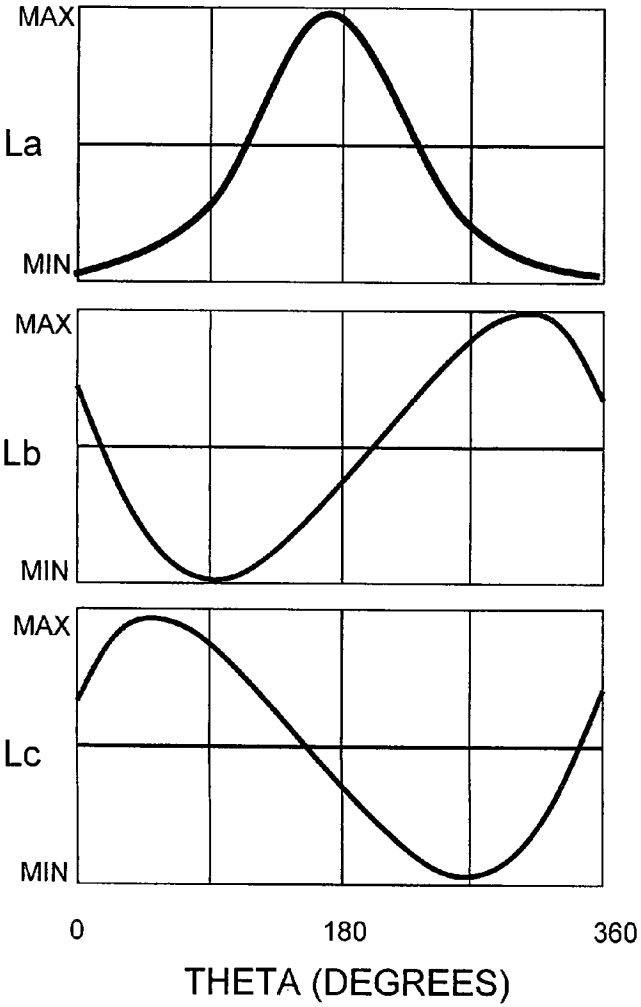
FIG. 3*a* shows plots of suspension tether lengths above the tether separation plate in an embodiment of the invention.
Figure 4C:
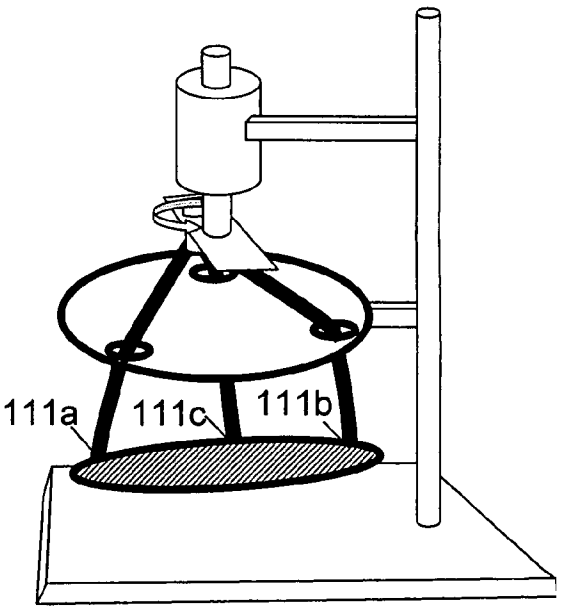
FIGS. 4*a*, 4*b*, and 4*c* illustrate a sample plate in three different extreme orientations.
Figure 4B:
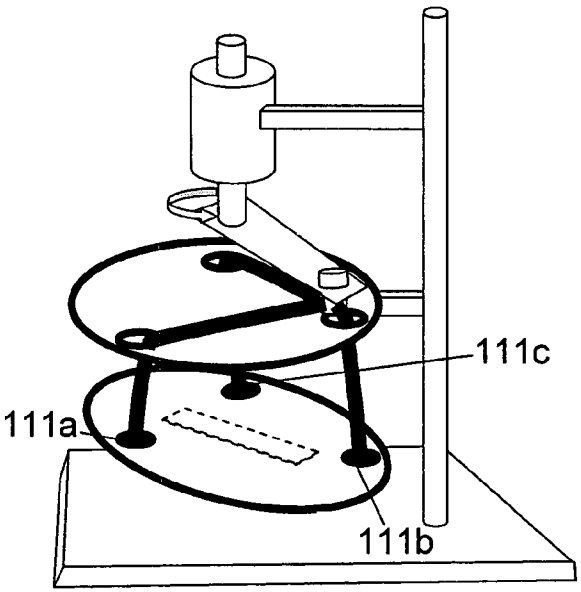
Figure 4A:
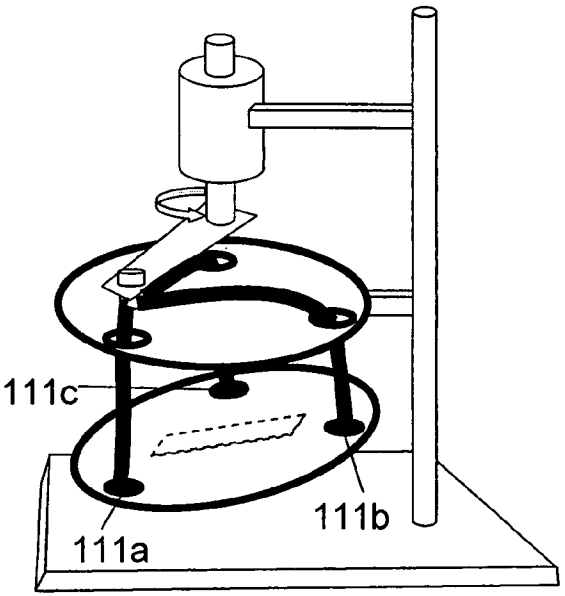

FIG. 2 shows a top view of suspension tether separation plate 106, with suspension tethers 110*a*, 110*b*, and 110*c* coupled to bearing 105 as it rotates in a circular path. The lengths of suspension tethers 110*a*, 110*b*, and 110*c* that extend above tether separation plate 106 are designated La, Lb, and Lc, respectively. An angle, theta 201, measures the rotational position of bearing 105, measured counterclockwise from the 108*a* orifice position. FIG. 3*a* plots the sinusoidal variations of La, Lb, and Lc versus the angle, theta. Because each of the lengths of suspension tethers 110*a*, 110*b*, and 110*c* are fixed, the larger the value of La, Lb, or Lc, the higher the heights of the attachment point 111*a*, 111*b*, or 111*c*, respectively, of sample plate 109, relative to base 112, as plotted in FIG. 3*b*. FIGS. 4*a*, 4*b*, and 4*c* show perspective views of the tilt of sample plate 109 when bearing 105 is positioned over orifices 108*a*, 108*b*, and 108*c*, respectively, of tether separation plate 106. The rotation of bearing 105 coupled to radial arm 104 thus provides a three-phase, sinusoidal tilting of sample plate 109, and microarray 114 resting on sample plate 109. The three-phase, sinusoidal tilting effectively agitates the target solution of a microarray in a manner that increases toward the periphery of, and decreases toward the center of, sample plate 109. In the embodiment illustrated, radial arm 104 is of such a length that bearing 105 passes substantially over orifices 108*a*, 108*b*, and 108*c* as it rotates. In other embodiments radial arm 104 can be longer or shorter. In a further embodiment, bearing 105 has an adjustable radial position in order to control the amplitude of the tilting of sample plate 109. In other embodiments, radial member 104 can be replaced with a disc to which bearing 105 can be coupled.

Suspension tethers 110*a*, 110*b*, and 110*c* can be made of any appropriate material, for example without exclusion: (i) single or multi-strand polymer, (ii) single or multi-strand natural fiber, (ii) single or multi-strand metal or metal alloy, (iv) single or multi-strand composite materials, or (v) chains made of polymer, metal, metal alloy, or composite materials. Suspension tethers 110*a*, 110*b*, and 110*c* can be coupled to sample plate 109 at attachment points 111*a*, 111*b*, and 111*c*, respectively using any one of a variety of mechanical coupling techniques (including passing through a hole near the perimeter of sample plate 109, and tying) that are well known to one of ordinary skill in the mechanical arts.

In the preceding, exemplary embodiments, suspension tethers 110*a*, 110*b*, and 110*c* are coupled to bearing 105 to prevent tangling as radial arm 104 rotates. In other embodiments, suspension tethers 110*a*, 110*b*, and 110*c* can be coupled directly to a radial member.

In some embodiments, orifices 108*a*, 108*b*, and 108*c* of sample plate 106 are configured to reduce friction with and wear to suspension tethers 110*a*, 110*b*, and 110*c*. Such configurations can include, for example, contoured cross-sectional profiles, coating with a low friction material such as polytetrafluroethylene (PTFE), and/or the insertion of a low friction grommet. Although suspension tether separation structure 106 has been illustrated as a disc with three orifices, 108*a*, 108*b*, and 108*c*, in other embodiments equivalent structures for maintaining the separation of suspension cords 110*a*, 110*b*, and 110*c* can be readily identified by one of ordinary skill in the art.

Figure 5:
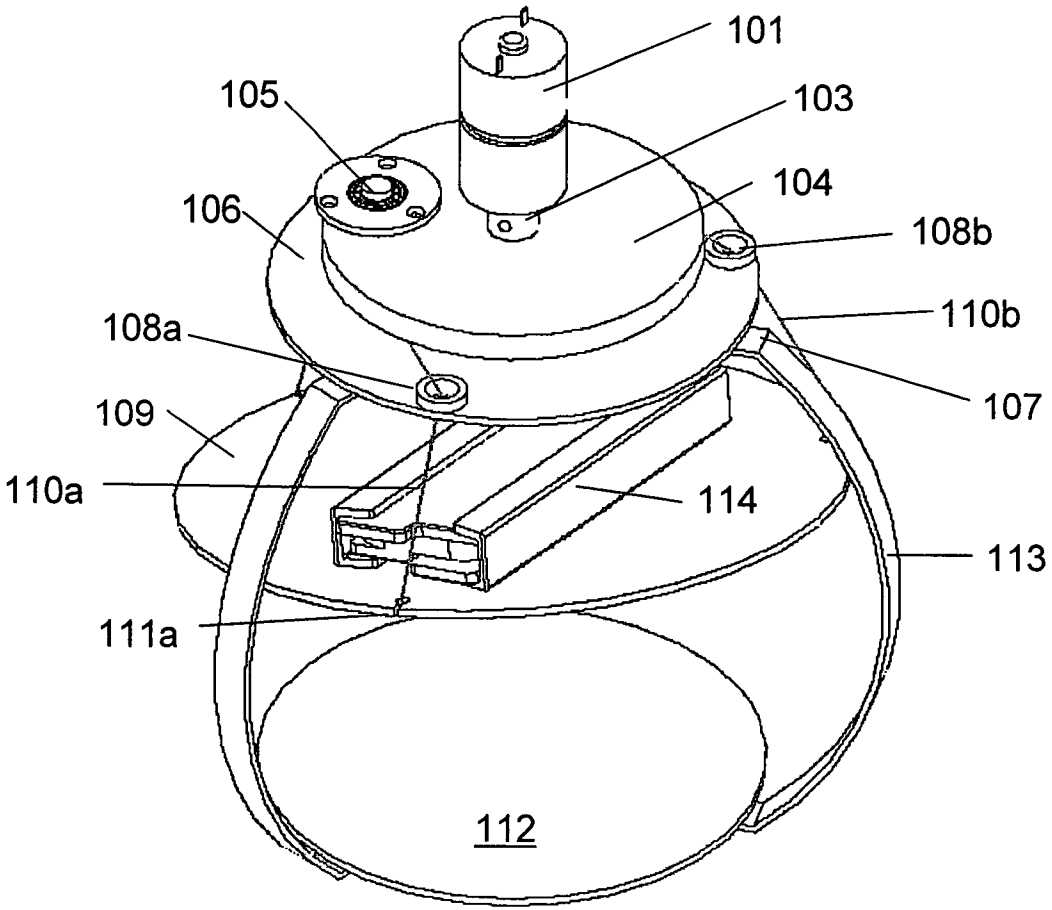
FIG. 5 illustrates a perspective view of another embodiment of the invention.

FIG. 5 illustrates another embodiment, in which radial arm 104 of FIG. 1 has been replaced by a disc 104 of FIG. 5, and there are three structural supports 113. Sample plate 109 and suspension tethers 110*a*, 110*b*, and 110*c* are water proof, so that microarray 114 may be immersed in a water bath to maintain a constant temperature during hybridization. The embodiment illustrated in FIG. 5 can hold cassettes for one to twenty microarrays. The microarray area can range up to 22 cm by 22 cm, to enable genome-wide assays.

Figure 6:
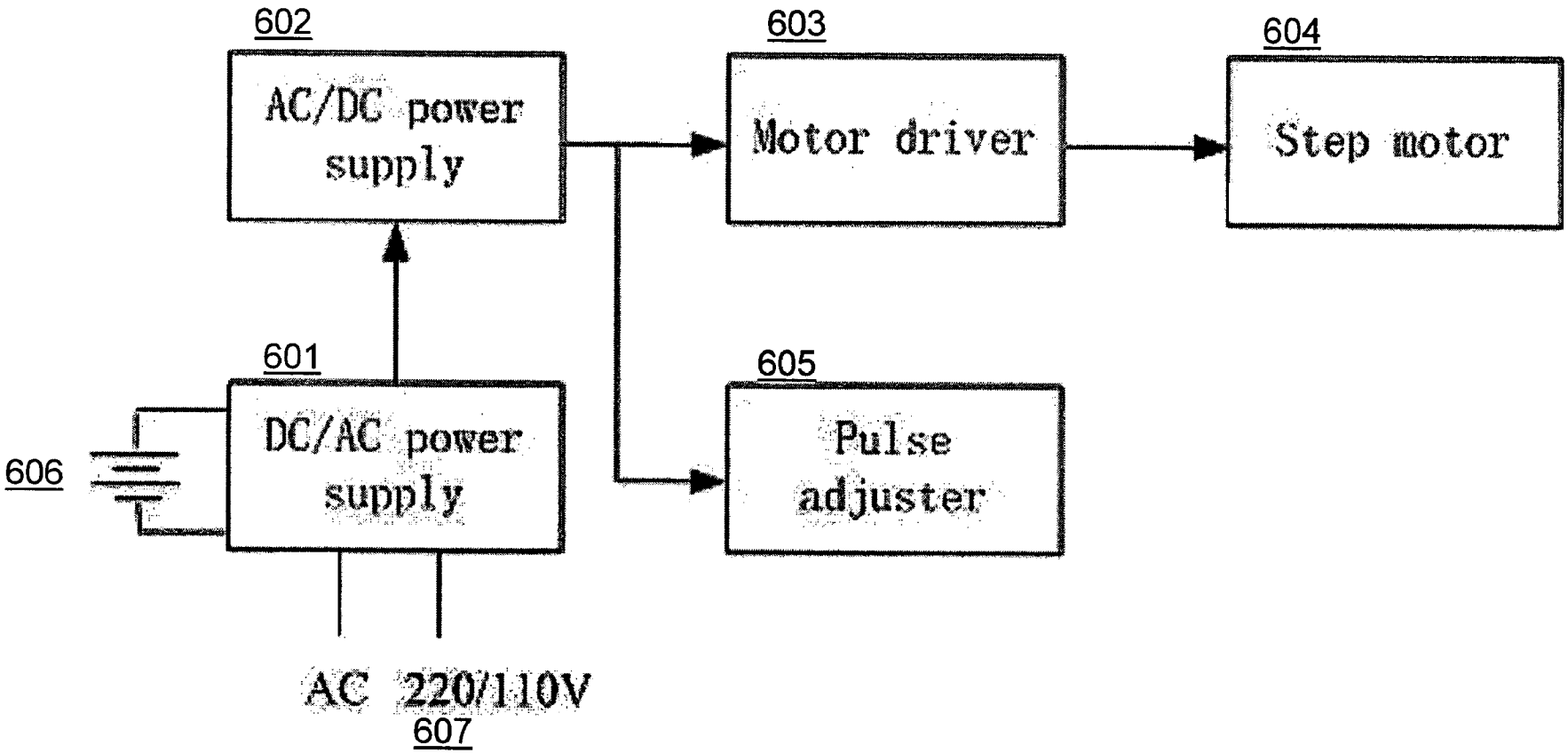
FIG. 6 is a block diagram for a motor control system according to an embodiment of the invention.

FIG. 6 is a block diagram of a controller for controlling motor 604 in an embodiment where the motor is a stepper motor. An uninterruptible power supply 601, having backup battery 606, is used to maintain the agitation of a microarray in the event of a mains power failure. AC/DC power supply 602 converts mains AC power to the dc power required by motor driver 603. Pulse adjuster 605 is used with motor driver 603 to control the speed of stepper motor 604, as it is driven by motor driver 603. Other embodiments can use other types of motors, for example without exclusion: (i) synchronous AC motors, (ii) brush-type DC motors; or (iii) brushless DC motors.

Experimental comparisons of microarray hybridization reactions conducted with agitation by the present invention, and conducted with only diffusive target solution transport (i.e. no agitation) for control purposes, indicate substantial improvements in hybridization intensity and uniformity when conducted with the present invention.

Figure 7A:
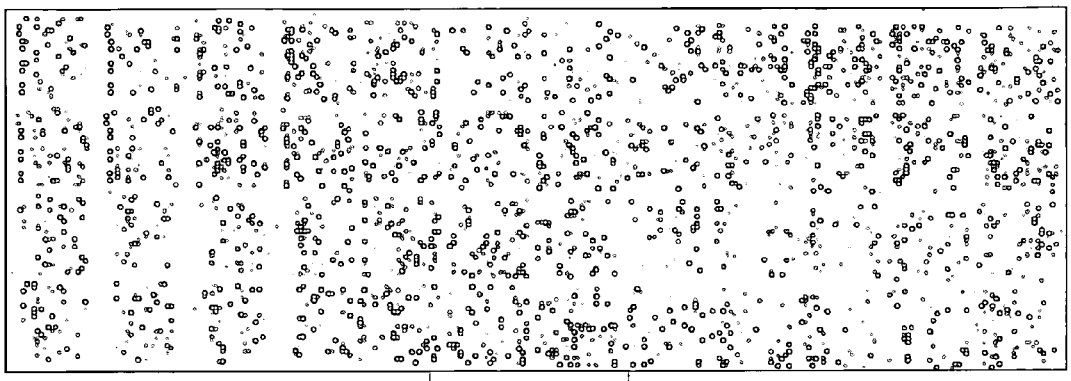
FIGS. 7*a* through 7*d* shows a hybridization result comparison between using microarray agitation according to an example of the present invention in a water bath and traditional microarray incubation without agitation in a water bath as an experimental control.
Figure 7B:
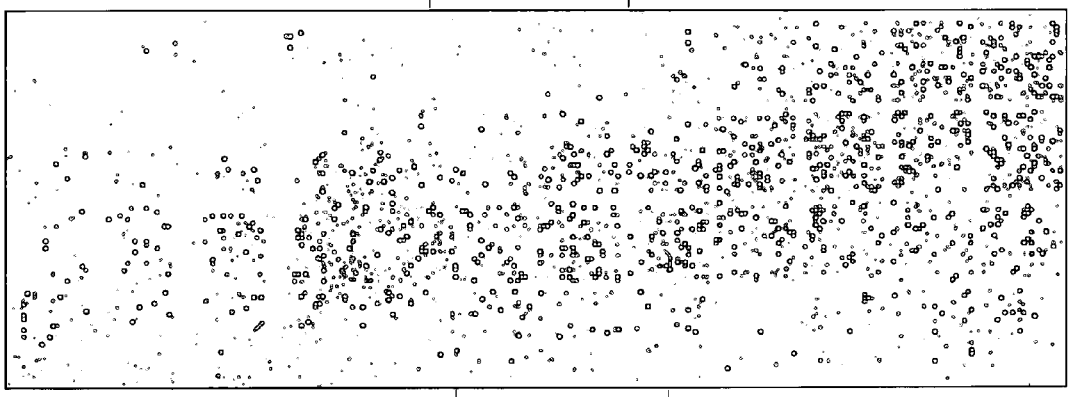
Figure 7C:
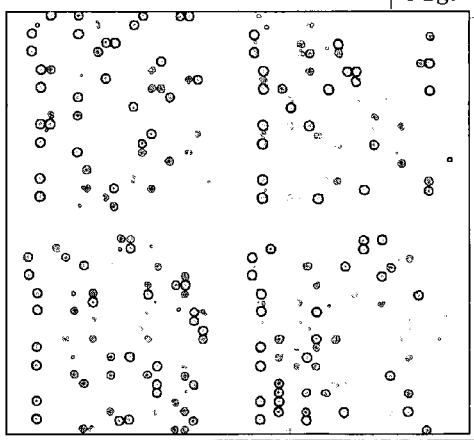
Figure 7D:
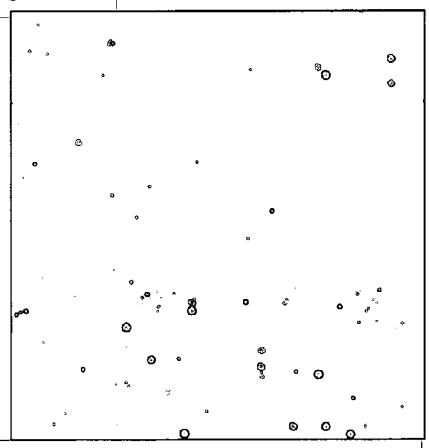

FIGS. 7*a* through 7*d* shows a hybridization result comparison between using microarray agitation according to the present invention in a water bath and traditional microarray incubation without agitation in a water bath as an experimental control. Otherwise, experimental conditions were identical: (i) identical biological samples, (ii) identical probes, (iii) identical hybridization conditions including use of the coverslip approach, hybridization temperature, hybridization time and so on, (iv) identical washing conditions, and (v) identical fluorescent scanner settings. FIG. 7*a* is a hybridization scan of a DNA microarray incubated overnight in a water bath using microarray agitation according to the present invention. FIG. 7*b* is a hybridization scan with the same parameters except using the traditional still (no agitation) incubation method as an experimental control. FIG. 7*c* is a detail of the upper left hand corner of FIG. 7*a*. FIG. 7*d* is a detail of the upper left hand corner of FIG. 7*b*. It is observed that the microarray (FIGS. 7*a* and 7*c*) incubated with agitation by the present invention results in substantially improved hybridization signal intensity and uniformity, compared with the microarray (FIGS. 7*b* and 7*d*) incubated under control conditions. The improvement may be due, in at least part, to enhanced fluid transport of the hybridization buffer under the coverslip caused by microarray agitation with the present invention.

The present invention can be implemented in disease diagnostic, biological and agricultural research, food safety detection, forensic authentication and their related fields.

Variations and extensions of the embodiments described are apparent to one of ordinary skill in the art. For example, in reference to FIG. 5, a holder to affix microarray 114 to sample plate 109 could be used to prevent microarray 114 from slipping off sample plate 109. Also, embodiments of the invention can be used to mechanically agitate devices or samples other than microarrays. Other applications, features, and advantages of this invention will be apparent to one of ordinary skill in the art who studies this invention disclosure. Therefore the scope of this invention is to be limited only by the following claims.

The invention claimed is:

1. An apparatus for agitating a sample, said apparatus comprising:

first, second, and third suspension tethers, each tether having first and second ends;

a sample holder, having first, second, and third attachment points to which the first ends of the first, second, and third suspension tethers, respectively, are coupled, thereby suspending the sample holder;

a suspension tether separation structure having first and second sides, and having first, second, and third orifices therethrough from the first to the second side, and wherein the first, second, and third suspension tethers, respectively, are passed through from the first side to the second side;

a radial member positioned at the second side of the suspension tether separation structure, to which the second ends of the first, second, and third suspension tethers are coupled, proximate to one another; and a motor coupled to the radial member by a rotatable shaft.

2. The apparatus of claim 1, wherein the second ends of the first, second, and third suspension tethers are coupled to the radial member by a bearing.

3. The apparatus of claim 2, wherein the bearing is coupled to the radial member at an adjustable radial position.

4. The apparatus of claim 1, wherein the suspension tether separation structure is a suspension tether separation plate.

5. The apparatus of claim 1, wherein the radial member is a radial arm.

6. The apparatus of claim 1, wherein the radial member is a disc.

7. The apparatus of claim 1, wherein the sample holder is a sample plate.

8. The apparatus of claim 1, wherein the sample holder further comprises at least one reaction cassette comprising positions for at least one microarray.

9. The apparatus of claim 1, wherein the sample holder is a tray.

10. The apparatus of claim 1, wherein heights of the first, second, and third suspension points of the sample plate vary substantially sinusoidally over time, and substantially one hundred twenty degrees out of phase with one another, as the radial member rotates.

11. An apparatus for agitating a microarray, said apparatus comprising:

a means for holding the microarray, said holding means having first, second, and third coplanar axes;

three suspension tethers attached to the holding means, said suspension tethers being capable of tilting the holding means along first, second, and third coplanar axes according to substantially sinusoidal first, second, and third functions of time, respectively; and a means for controlling amplitudes of the first, second, and third functions of time.

12. The apparatus of claim 11, wherein the means for controlling amplitudes of the first, second, and third functions of time comprises a bearing coupled to a radial member.

13. The apparatus of claim 12, wherein the bearing has an adjustable radial position.

14. An apparatus for agitating a microarray, said apparatus comprising:

a means for holding the microarray, said holding means having first, second, and third coplanar axes;

three suspension tethers attached to the holding means, said suspension tethers being capable of tilting the holding means along first, second, and third coplanar axes according to substantially sinusoidal first, second, and third functions of time, respectively; and a means for controlling frequencies of the first, second, and third functions of time.

15. The apparatus of claim 14, wherein the means for controlling frequencies of the first, second, and third functions of time comprises a motor.

16. The apparatus of claim 15, wherein the motor is selected from the group consisting of: a stepper motor, a synchronous AC motor, a brush-type DC motor, and a brushless DC motor.

* * * * *